US006378157B1

(12) United States Patent
Kosla et al.

(10) Patent No.: US 6,378,157 B1
(45) Date of Patent: Apr. 30, 2002

(54) FOAM SURFACE CONDITIONING PAD

(75) Inventors: James Francis Kosla, Schaumburg, IL (US); Edward C. Weichman, Rock Hill, SC (US); Daniel Leonard Maloney, Jr., Chicago, IL (US); Marion A. Royse, Maryville, TN (US)

(73) Assignee: Schlegel Corporation, New York, NY (US)

( * ) Notice: Subject to any disclaimer, the term of this patent is extended or adjusted under 35 U.S.C. 154(b) by 0 days.

(21) Appl. No.: 09/548,284

(22) Filed: Apr. 12, 2000

(51) Int. Cl.[7] ..... A47L 11/164

(52) U.S. Cl. ..... 15/230; 15/97.1

(58) Field of Search ..... 15/97.1, 230, 230.18, 15/230.19; 451/526, 527, 530

(56) References Cited

U.S. PATENT DOCUMENTS

| | | | | |
|---|---|---|---|---|
| 392,979 | A | | 11/1888 | Bacon |
| 2,090,814 | A | | 8/1937 | Seybert |
| 2,229,745 | A | * | 1/1941 | Kneisley |
| 2,994,899 | A | | 8/1961 | Moilanen |
| 3,159,905 | A | * | 12/1964 | Baggett |
| 3,395,417 | A | * | 8/1968 | Matouka |
| 3,418,675 | A | * | 12/1968 | Meguire et al. |
| 4,523,411 | A | * | 6/1985 | Freerks |
| D284,969 | S | | 8/1986 | Olovsson |
| 4,615,066 | A | | 10/1986 | Colognori |
| D315,236 | S | | 3/1991 | Kraselsky et al. |
| 5,007,128 | A | | 4/1991 | Englund et al. |
| 5,185,964 | A | | 2/1993 | Englund et al. |
| D367,743 | S | | 3/1996 | Krause et al. |
| 5,527,215 | A | | 6/1996 | Rubin et al. |
| 5,662,515 | A | * | 9/1997 | Evensen |
| 5,893,191 | A | | 4/1999 | Schneider et al. |
| 5,946,760 | A | * | 9/1999 | Eames |
| 6,001,009 | A | | 12/1999 | Kaiser et al. |
| 6,044,512 | A | * | 4/2000 | Hornby et al. |

* cited by examiner

*Primary Examiner*—Terrence R. Till
(74) *Attorney, Agent, or Firm*—Brian B. Shaw, Esq.; Stephen B. Salai, Esq.; Harter, Secrest & Emery LLP

(57) ABSTRACT

A surface conditioning pad for rotation about an axis is disclosed, wherein the pad includes a resilient foam body having a rear surface and a working surface generally normal to the axis of rotation and a peripheral surface interconnecting the rear surface and the working surface. The peripheral surface includes a plurality of facets which may define an apex for selectively engaging portions of the work piece.

16 Claims, 16 Drawing Sheets

FIG. 34
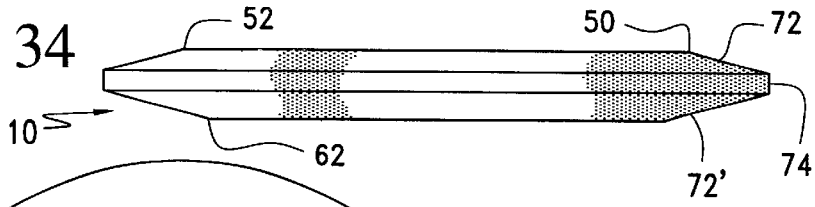
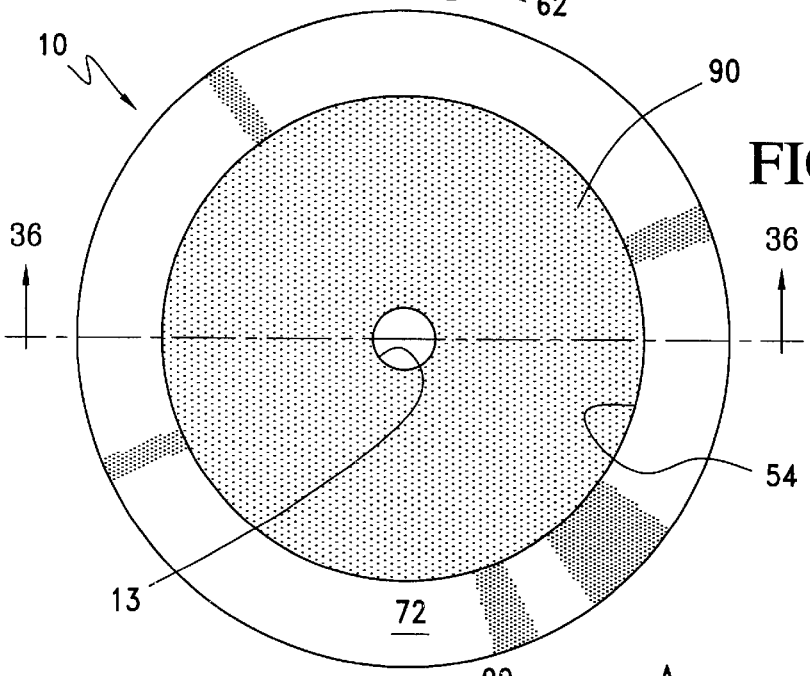
FIG. 35
FIG. 36
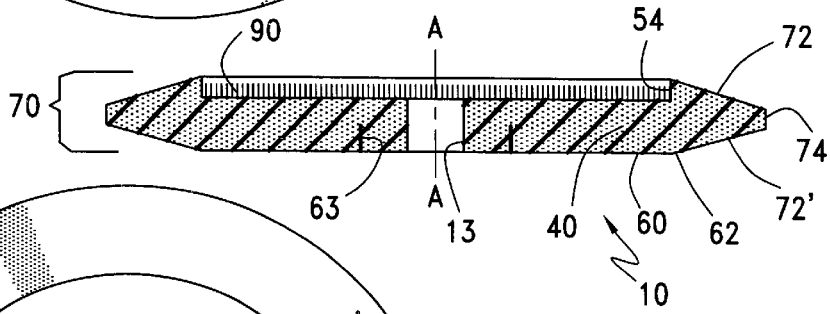
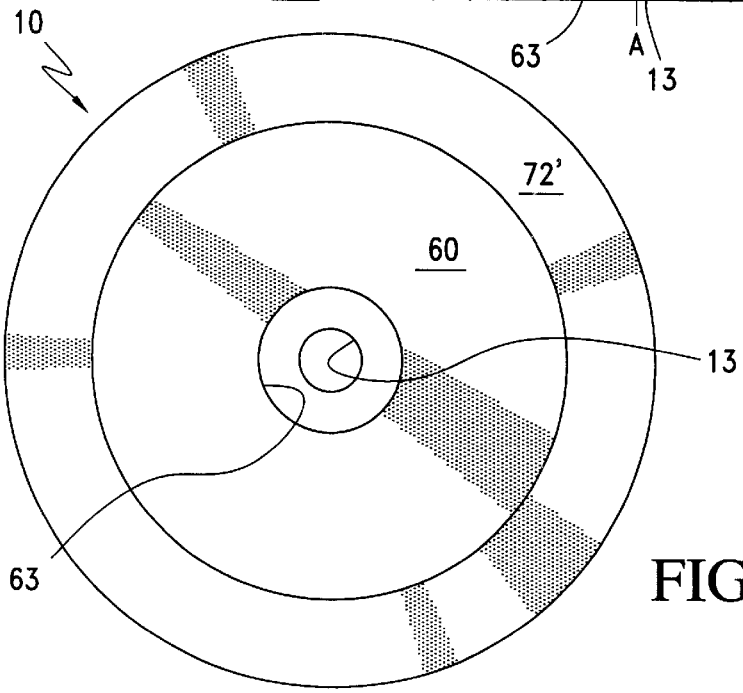
FIG. 37

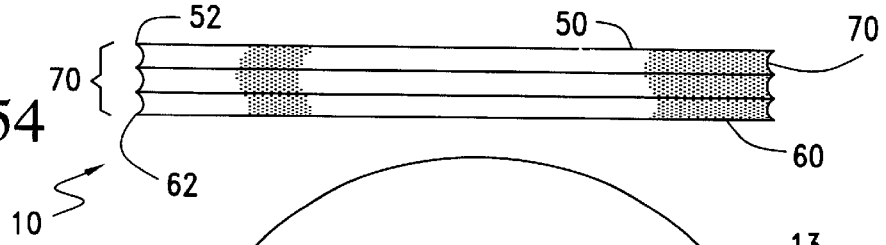
FIG. 54
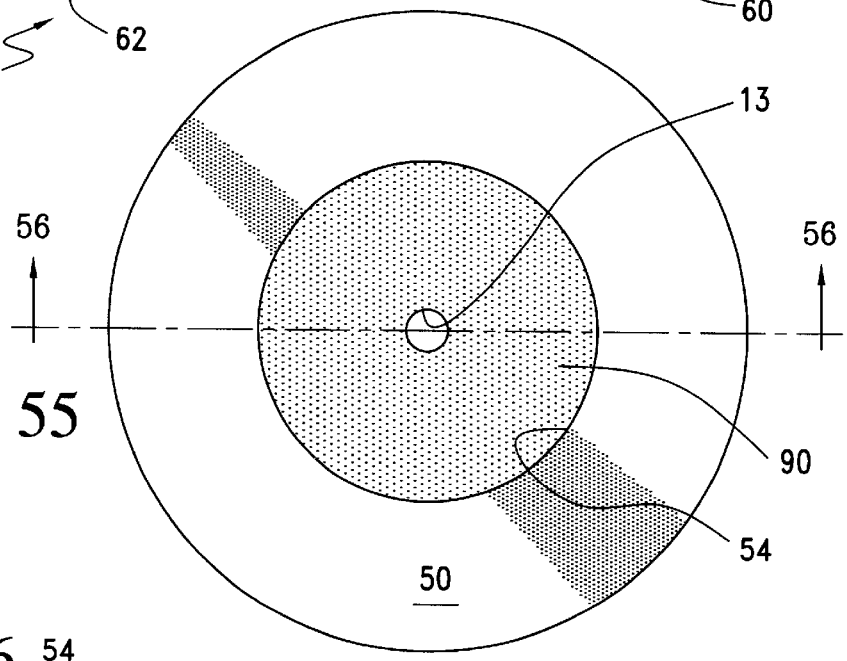
FIG. 55
FIG. 56
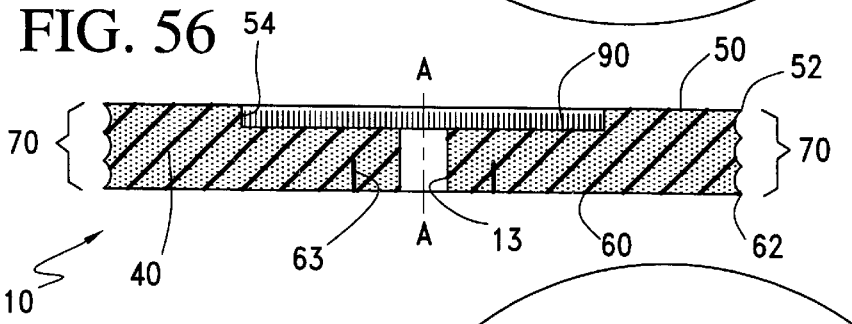
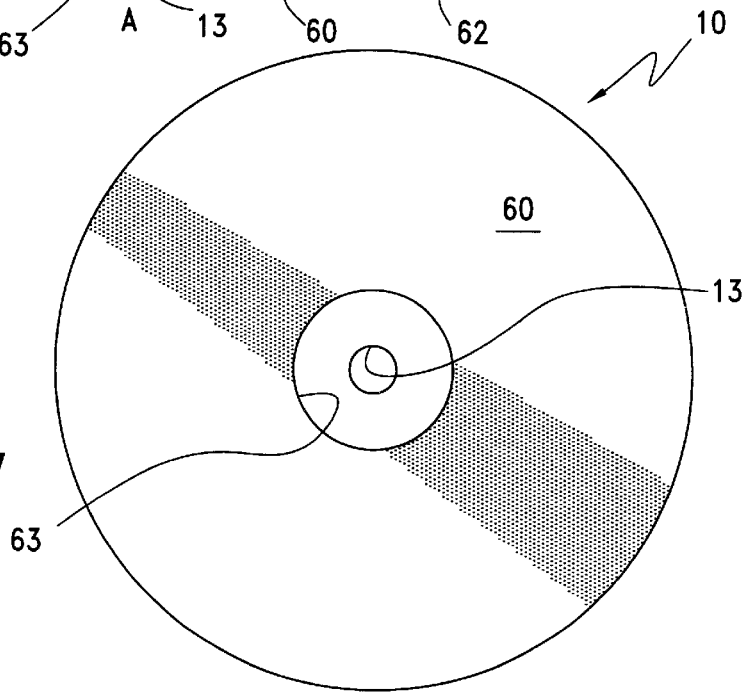
FIG. 57

FOAM SURFACE CONDITIONING PAD

FIELD OF THE INVENTION

The present invention relates to surface conditioning tools and, more particularly, to a surface conditioning pad having a foam body with a peripheral surface configured for working multi-angle work pieces.

BACKGROUND OF THE INVENTION

Rotary surface conditioning tools, such as pads and buffs, are often used for buffing and polishing painted or similarly finished surfaces. Traditionally, these buffs were formed of wool or tufts of material adhered to a backing plate.

Foam buffing pads are now used in many buffing and polishing operations where the traditional tufted pads were previously used. Foam pads including polyurethane foam, with both reticulated and non-reticulated cell structures have become particularly popular.

However, despite certain advantages of polymer foam pads over fibrous and tufted pads, there are still a number of inherent disadvantages attendant to the use of foam pads. One of these disadvantages is the difficulty in conditioning surfaces that are not generally planar. The disadvantages also include "chatter" or jumping of the pad by excess frictional surface contact between flat portions of the pad and the surface being finished; splattering of the polish or other finishing compound as a result of the compound being thrown radially outward by centrifugal force; and burning of the work surface being finished by the high speed outer edge portions of the pad.

Attempts have been made to minimize or eliminate these problems by varying the type and density of foam used and by configuring the planar work surface of the pads. One attempt at solving the problems presented by flat foam buffing pads was the introduction of buffing pads having working surfaces with a convoluted or waffled shape such as U.S. Pat. No. 5,007,128.

However, the needs still remain for a foam buff that can be rotated about an axis of rotation of the pad having a major working surface generally normal to the axis of rotation wherein the pad is configured for working angled of the work piece. Specifically, the need exists for a surface conditioning pad having a peripheral edge that is configured to condition restricted spaces, while the pad provides sufficient support for such peripheral edge. The need further exists for a surface conditioning pad having a peripheral edge that is located and supported to provide enhanced wear characteristics.

SUMMARY OF THE INVENTION

The present invention provides a surface conditioning pad for rotation about an axis, wherein the pad is configured to access grooves and recesses in a work piece. The present pad has a peripheral surface formed by a plurality of intersecting facets. In a preferred configuration, planar facets intersect to form an apex which is spaced from a mid-height of the buff. In a further configuration, the peripheral surface is formed by a single facet extending between a rear surface and a working surface of the pad, wherein the facet is planar and the plane of the facet intersects the axis of rotation.

In alternative configurations, it is contemplated the facets may be curvilinear or a combination of curvilinear facets and planar facets. In a further configuration, the surface conditioning pad cooperates with a coupler pad. The coupler pad reduces the volume of material that is discarded when the pad is replaced. That is, the portions of the pad that are subjected to the greatest wear are separable from a portion of the pad that does not contact a work piece.

BRIEF DESCRIPTION OF THE DRAWINGS

FIG. 34 is a side elevational view of a truncated equal double taper configuration of the surface conditioning pad, wherein the left, right, front and rear of views are identical.

FIG. 35 is a top plan view of the surface conditioning pad of FIG. 34.

FIG. 36 is a cross sectional view taken along line 36—36 of FIG. 35.

FIG. 37 is a bottom plan view of the surface conditioning pad of FIG. 34.

FIG. 54 is a side elevational view of a scalloped configuration of a surface conditioning pad, wherein the left, right, front and rear of views are identical.

FIG. 55 is a top plan view of the surface conditioning pad of FIG. 54.

FIG. 56 is a cross sectional view taken along line 56—56 of FIG. 55.

FIG. 57 is a bottom plan view of the surface conditioning pad of FIG. 54.

DETAILED DESCRIPTION OF THE PREFERRED EMBODIMENT

Figure 1:
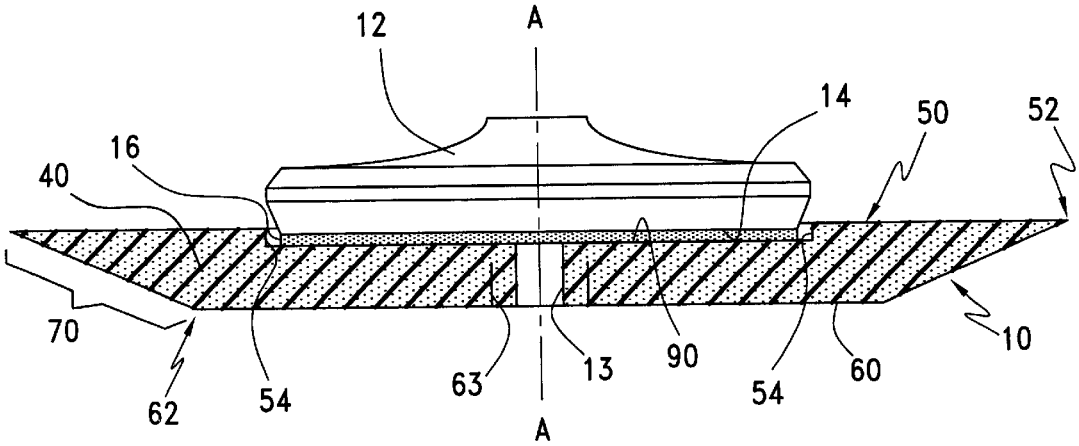
FIG. 1 is a side elevational, partial cross sectional view of a foam surface conditioning pad operably engaged with a backing plate.
Figure 62:
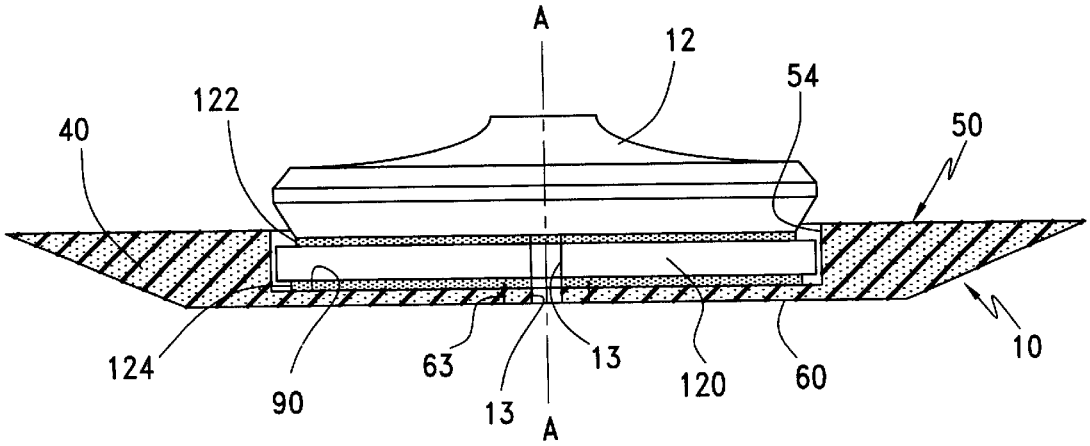
FIG. 62 is side elevational partial cross sectional view showing an alternative construction of the surface conditioning pad.

Referring to FIGS. 1–62, there is shown a surface conditioning pad 10 in accordance with the present invention.

These surface conditioning pad 10 is adapted to be connected to a rotary mount. The rotary mount includes a backing plate 12 having a generally planar circular support surface 14 perpendicular to the axis of rotation A—A. A mount is that as manufactured by Auto Quip, Inc. of Kimball Mich. The mount and attached pad 10 are rotatable by a motorized drive unit, i.e., a standard automotive type polisher adapted to rotate the backup plate at a speed in the range of approximately 1200 to 3000 rpms, such as the single or variable speed electrically activated drive units available from Black and Decker or variable speed air pressure activated drive units. The backing plate 12 is thus rotated about axis A—A normal to the support surface 14. The backing plate 12 may include a component of a hook and loop fastener 16. Alternatively, the backing plate may cooperate with a shaft and fastener, such as a nut and a washer to engage the foam pad 10.

The surface conditioning pad 10 includes a resiliently compressible foam body 40 having a generally planar rear surface 50, a generally planar working surface 60, a peripheral surface 70, and an engaging layer 90. The rear surface 50 is circumscribed by a rear periphery 52 and the working surface 60 is circumscribed by a front periphery 62, wherein the peripheral surface 70 extends between the rear periphery and the front periphery.

As shown in FIGS. 1, 3, 4, 7 the rear surface 50 of the body 40 may include the engaging layer 90. Preferably, the engaging layer 90 is non-releasably connected to the foam body 40. The engaging layer 90 provides stiffness and support for the foam body 40. In addition, the engaging layer 90 may include a component of a hook and loop fastener for releasably engaging the backing plate 12.

The engaging layer 90 may be adhered to the rear surface 50 of the foam body 40 by a hot melt adhesive or by flame laminating. The engaging layer 90 may be porous and made in the manner described in U.S. Pat. No. 4,609,581 (the content whereof is incorporated herein by reference) for placing loops in a carrier web of a structure described in that patent. Attachment of the engaging layer 90 to the foam body 40 may be achieved by a porous web (e.g., 50 percent open area) of hot melt adhesive (e.g., "SHARNET" 4200, available from Sharnet Corp., Ward Hill, Mass.) or by flame laminating. These procedures have been found to provide passageways between the engaging layer 90 and the foam body 40 that afford passage of liquid therebetween to facilitate cleaning of the surface conditioning pad 10.

Although not required, the engaging layer 90 is preferably recessed from the rear periphery 52 to define a shoulder 54 therebetween. The annular shoulder 54 is sized to encircle the backing plate 12 and hence assist in centering the pad 10 with respect to the axis of rotation A—A.

The surface conditioning pad 10 includes a central aperture 13. The central aperture is sized to receive a corresponding shaft or bolt of the drive mechanism.

Figure 5:
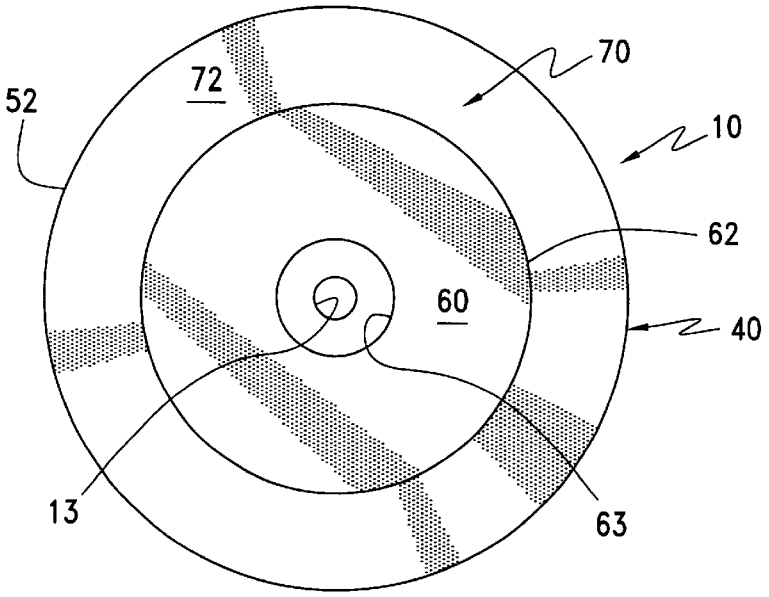
FIG. 5 is a bottom plan view of the surface conditioning pad of FIG. 2.
Figure 6:
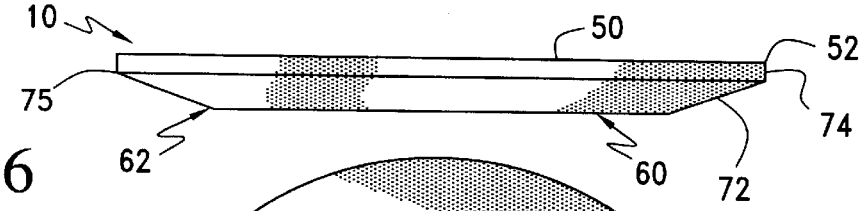
FIG. 6 is a side elevational view of a truncated single taper configuration of the surface conditioning pad, wherein the left, right, front and rear of views are identical.
Figure 7:
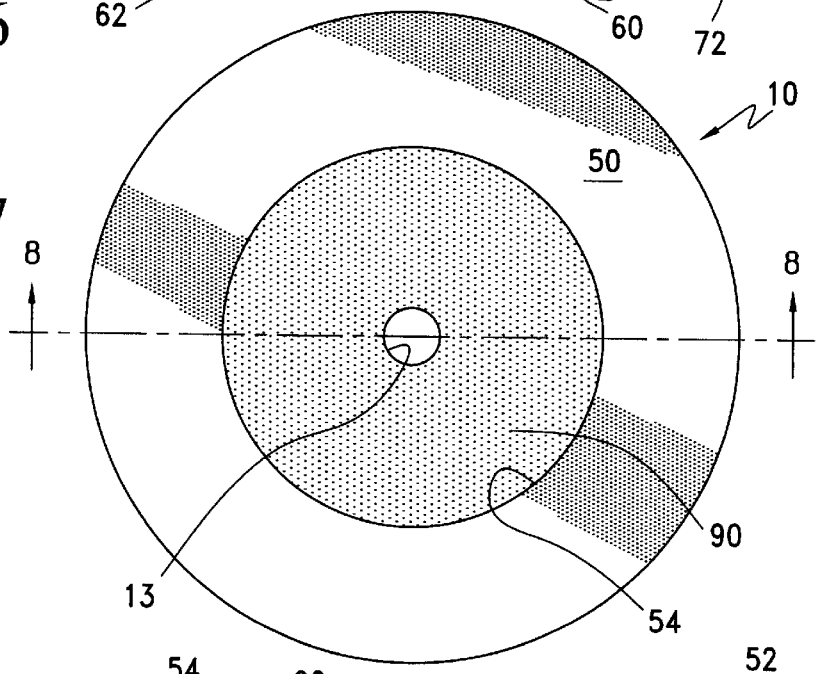
FIG. 7 is a top plan view of the surface conditioning pad of FIG. 6.
Figure 8:
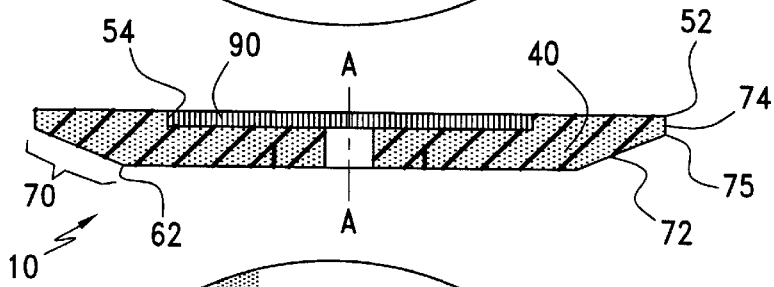
FIG. 8 is a cross sectional view taken along line 8—8 of FIG. 7.
Figure 9:
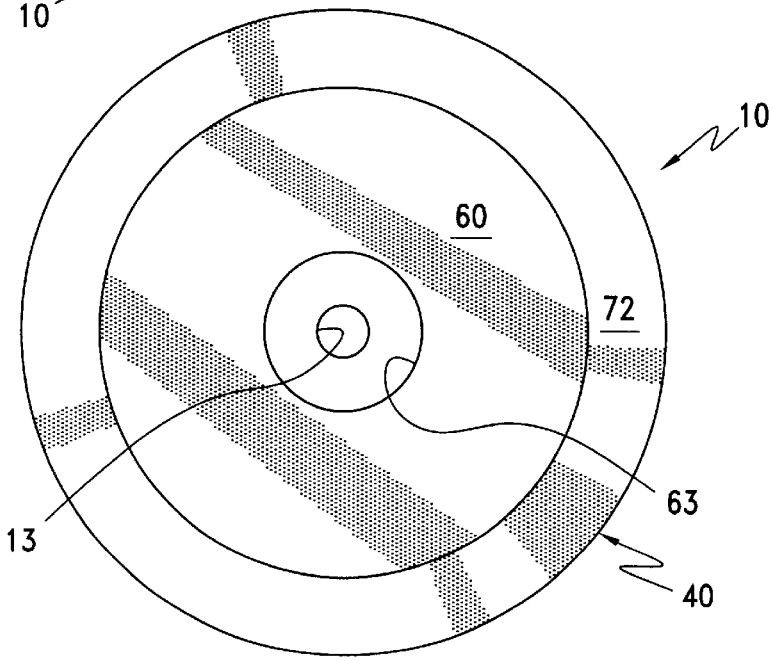
FIG. 9 is a bottom plan view of the surface conditioning pad of FIG. 6.
Figure 10:
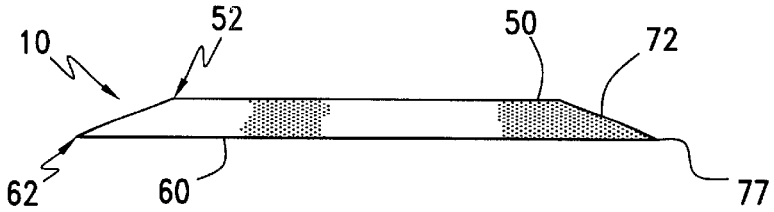
FIG. 10 is a side elevational view of an inverted single taper configuration of the surface conditioning pad, wherein the left, right, front and rear of views are identical.
Figure 11:
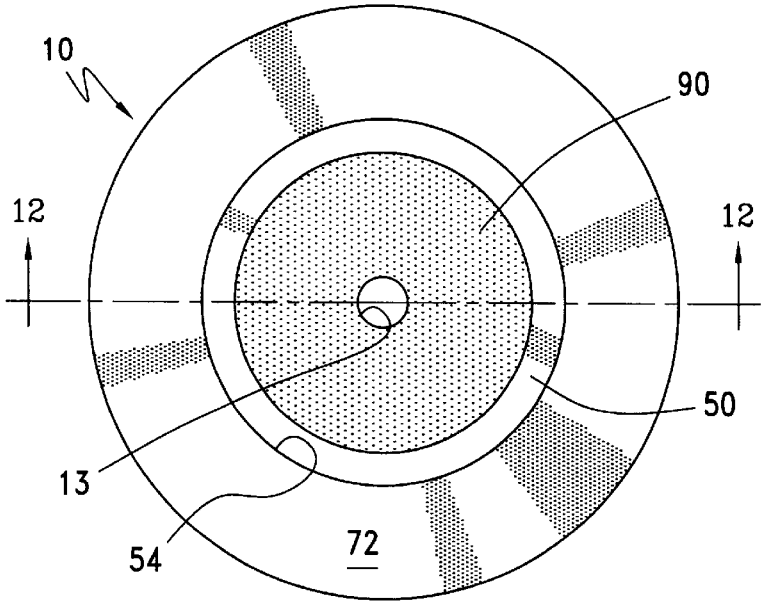
FIG. 11 is a top plan view of the surface conditioning pad of FIG. 10.
Figure 12:
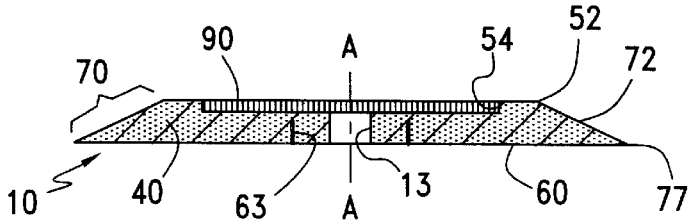
FIG. 12 is a cross sectional view taken along line 12—12 of FIG 11.
Figure 13:
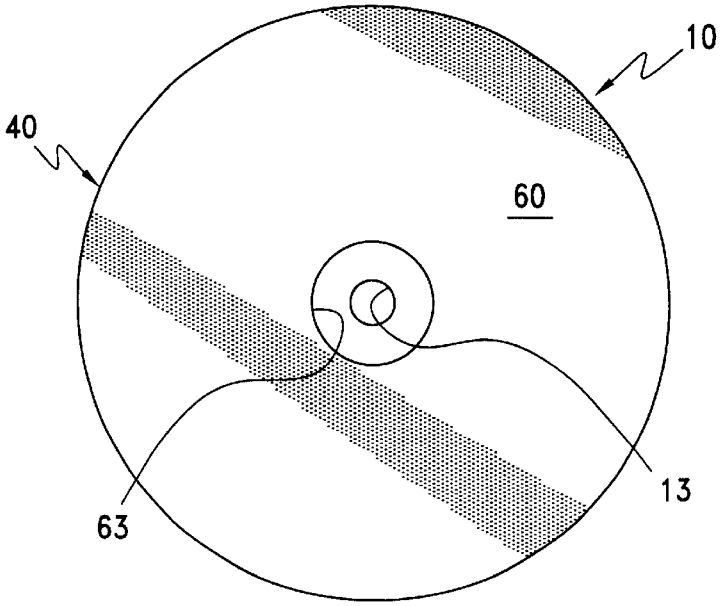
FIG. 13 is a bottom plan view of the surface conditioning pad of FIG. 10.
Figure 14:
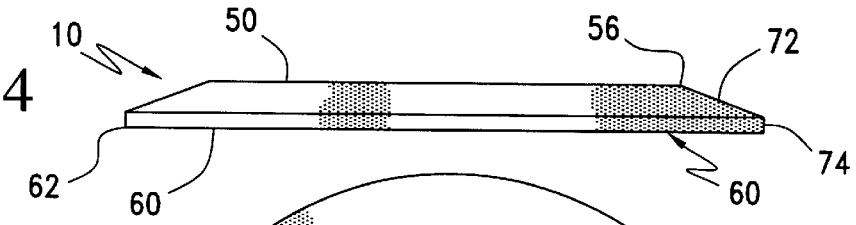
FIG. 14 is a side elevational view of a truncated inverted single taper configuration of the surface conditioning pad, wherein the left, right, front and rear of views are identical.
Figure 15:
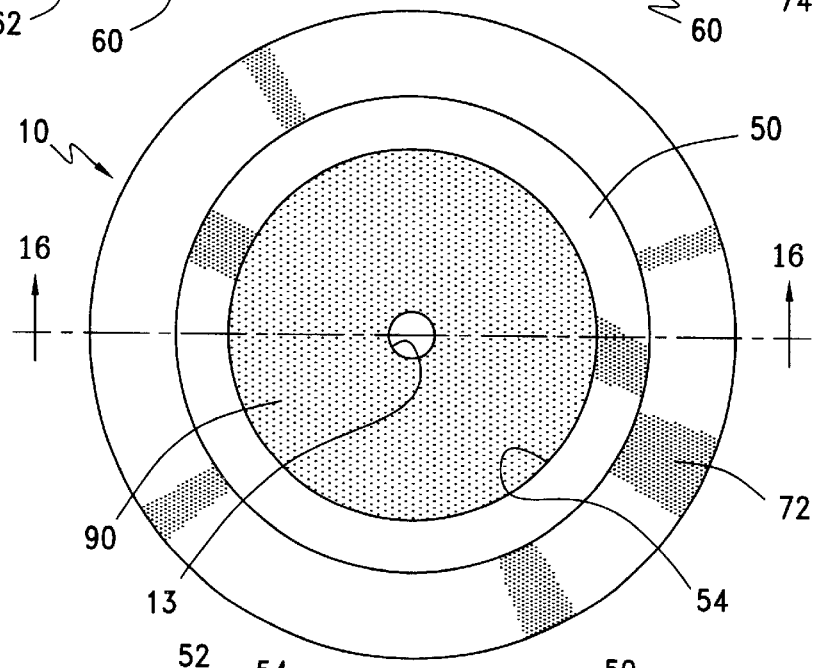
FIG. 15 is a top plan view of the surface conditioning pad of FIG. 14.
Figure 16:
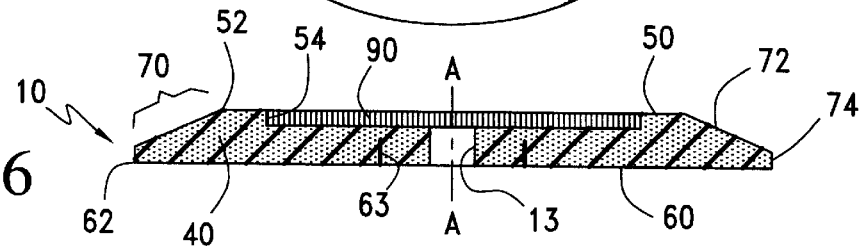
FIG. 16 is a cross sectional view taken along line 16—16 of FIG. 15.
Figure 17:
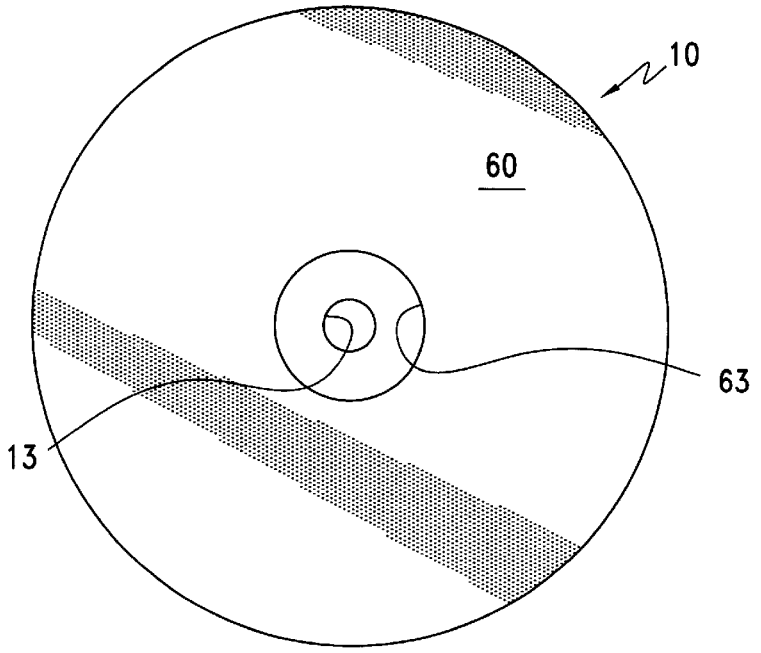
FIG. 17 is a bottom plan view of the surface conditioning pad of FIG. 14.
Figure 18:
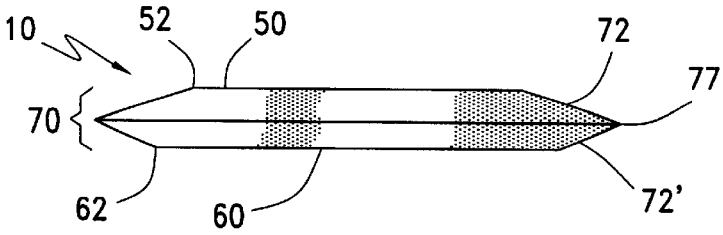
FIG. 18 is a side elevational view of an unequal double taper configuration of the surface conditioning pad, wherein the left, right, front and rear of views are identical.
Figure 19:
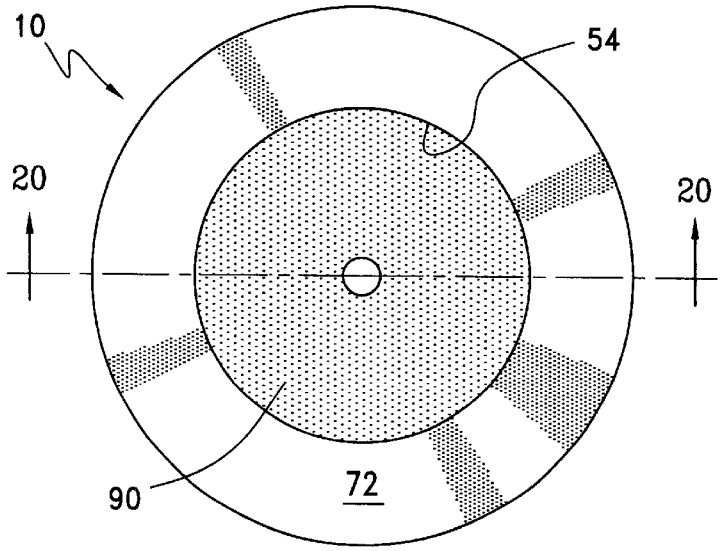
FIG. 19 is a top plan view of the surface conditioning pad of FIG. 18.
Figure 20:
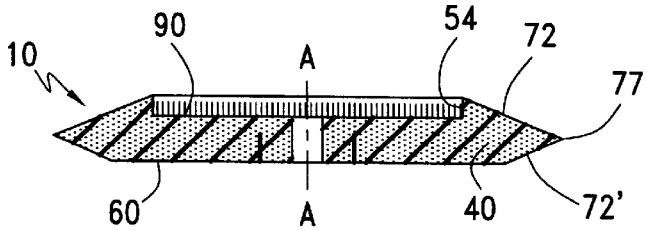
FIG. 20 is a cross sectional view taken along line 20—20 of FIG. 19.
Figure 21:
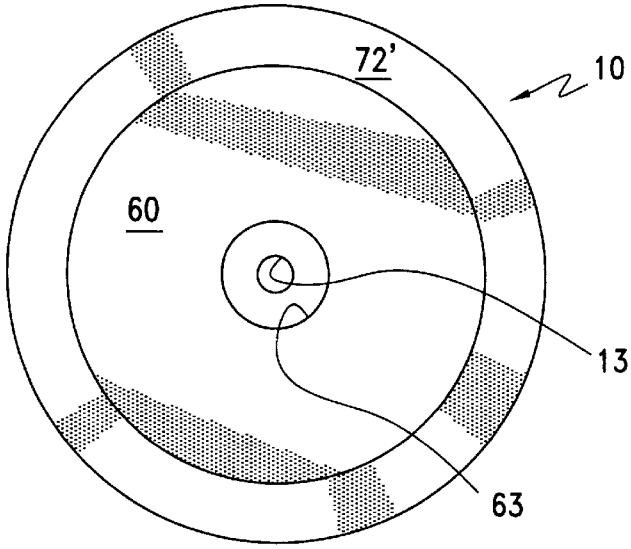
FIG. 21 is a bottom plan view of the surface conditioning pad of FIG. 18.
Figure 22:
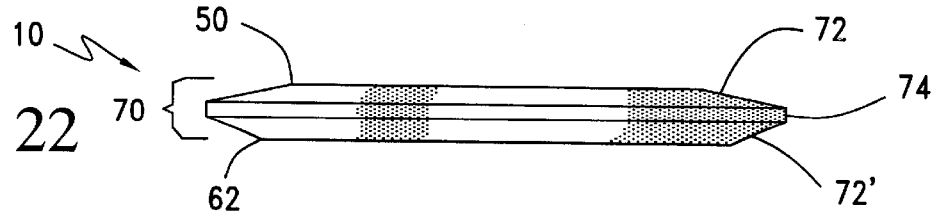
FIG. 22 is a side elevational view of a truncated unequal double taper configuration of the surface conditioning pad, wherein the left, right, front and rear of views are identical.
Figure 23:
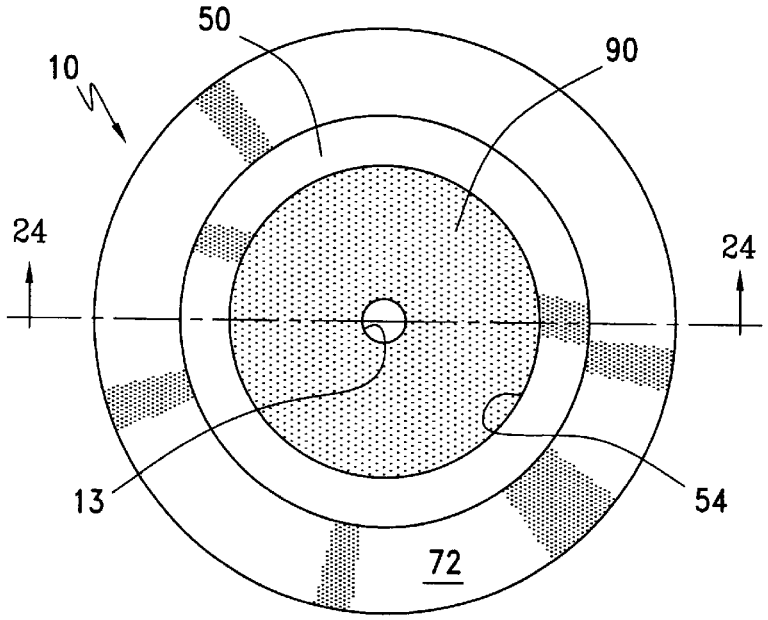
FIG. 23 is a top plan view of the surface conditioning pad of FIG. 22.
Figure 24:
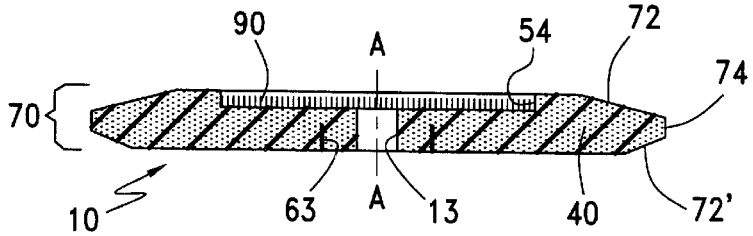
FIG. 24 is a cross sectional view taken along line 24—24 of FIG. 23.
Figure 25:
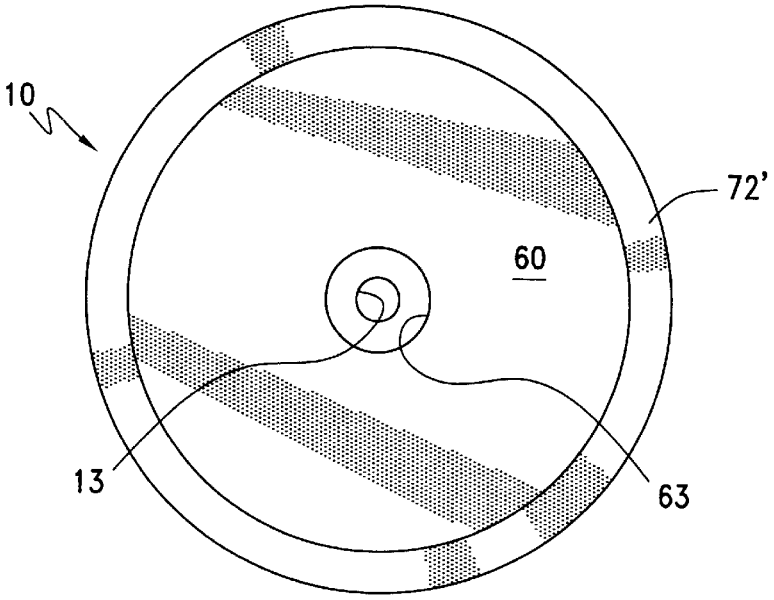
FIG. 25 is a bottom plan view of the surface conditioning pad of FIG. 22.
Figure 26:
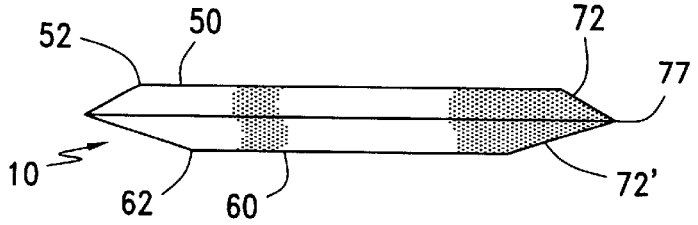
FIG. 26 is a side elevational view of an inverted unequal double taper configuration of the surface conditioning pad, wherein the left, right, front and rear of views are identical.
Figure 27:
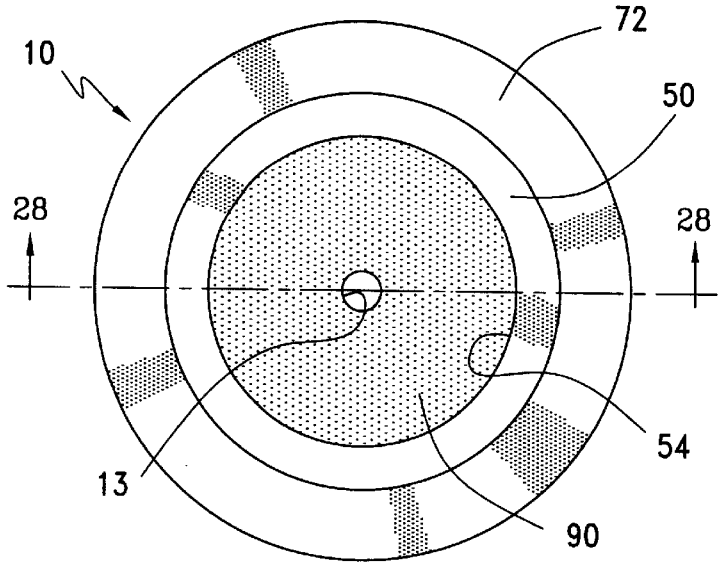
FIG. 27 is a top plan view of the surface conditioning pad of FIG. 26.
Figure 28:
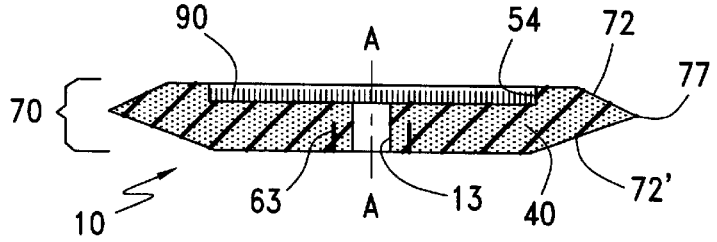
FIG. 28 is a cross sectional view taken along line 28—28 of FIG. 27.
Figure 29:
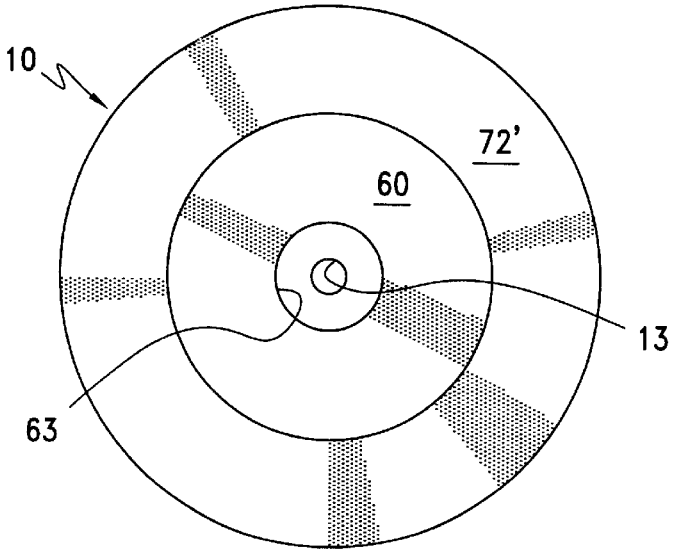
FIG. 29 is a bottom plan view of the surface conditioning pad of FIG. 26.
Figure 30:
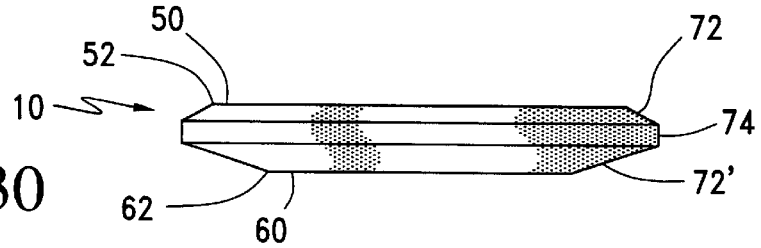
FIG. 30 is a side elevational view of a truncated inverted unequal double taper configuration of the surface conditioning pad, wherein the left, right, front and rear of views are identical.
Figure 31:
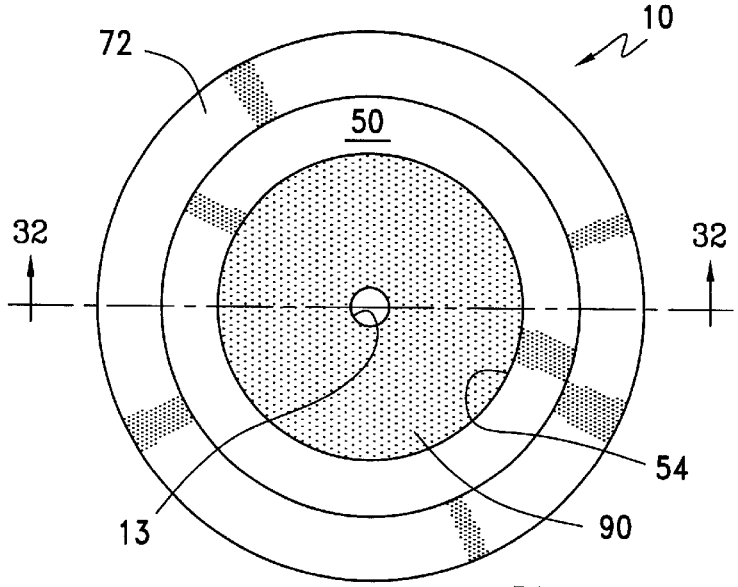
FIG. 31 is a top plan view of the surface conditioning pad of FIG. 30.
Figure 32:
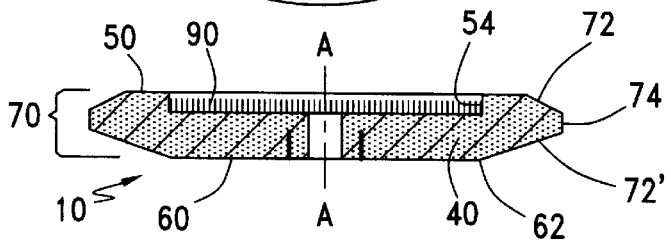
FIG. 32 is a cross sectional view taken along line 32—32 of FIG. 31.
Figure 33:
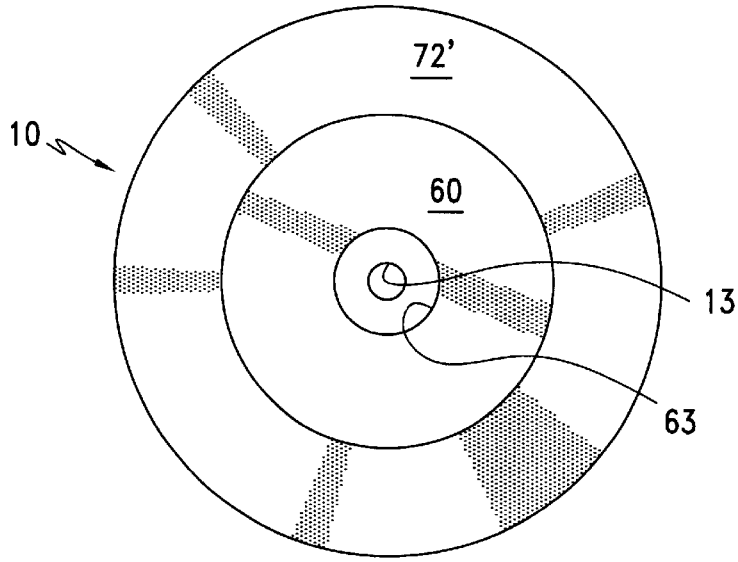
FIG. 33 is a bottom plan view of the surface conditioning pad of FIG. 30.
Figure 38:
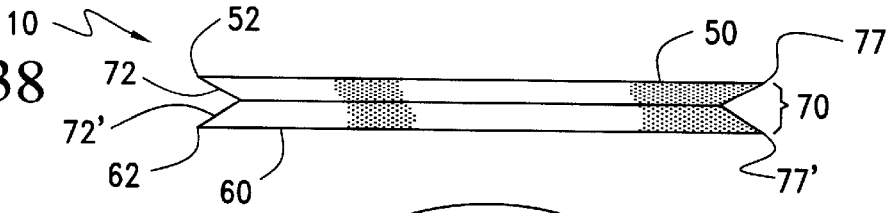
FIG. 38 is a side elevational view of an inverted equal double taper configuration of the surface conditioning pad, wherein the left, right, front and rear of views are identical.
Figure 39:
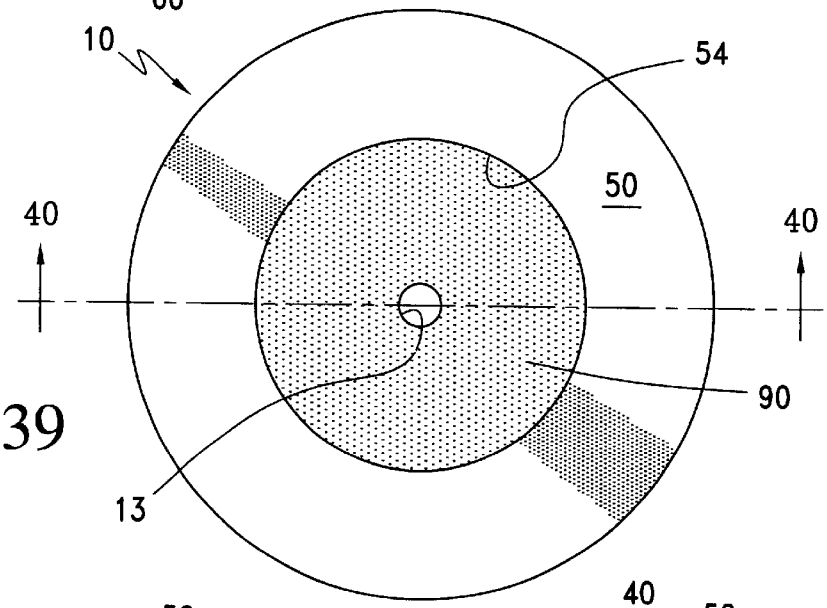
FIG. 39 is a top plan view of the surface conditioning pad of FIG. 38.
Figure 40:
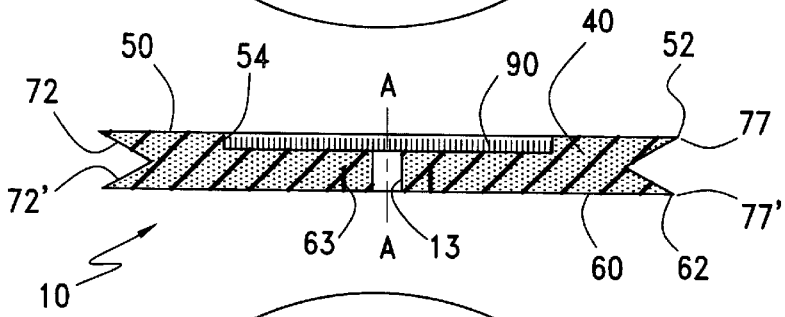
FIG. 40 is a cross sectional view taken along line 40—40 of FIG. 39.
Figure 41:
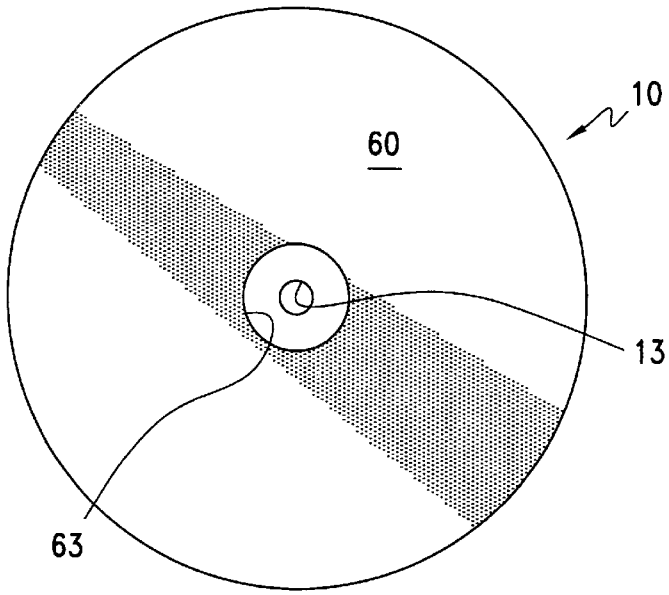
FIG. 41 is a bottom plan view of the surface conditioning pad of FIG. 38.
Figure 42:
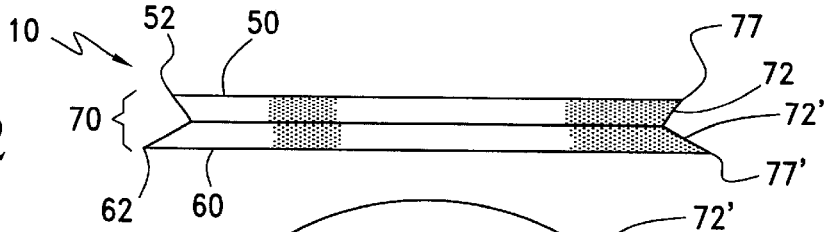
FIG. 42 is a side elevational view of an inverted unequal rear reduced double taper configuration of the surface conditioning pad, wherein the left, right, front and rear of views are identical.
Figure 43:
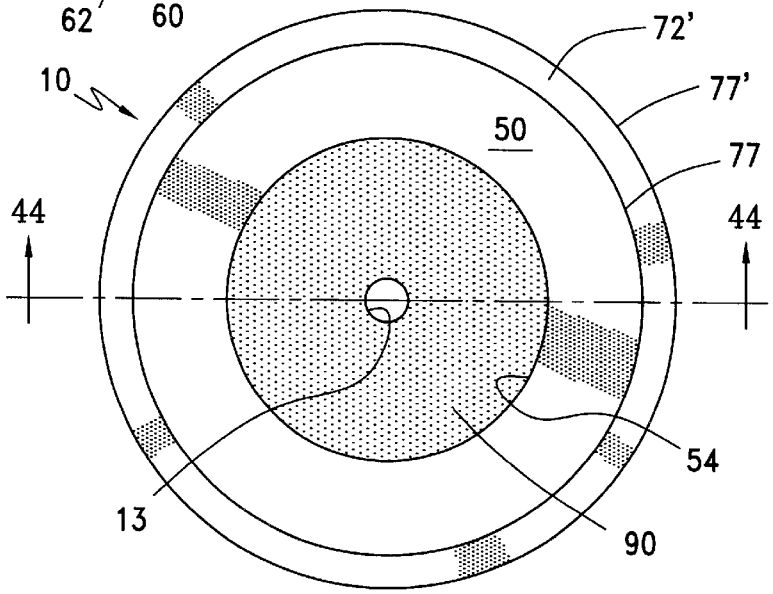
FIG. 43 is a top plan view of the surface conditioning pad of FIG. 42.
Figure 44:
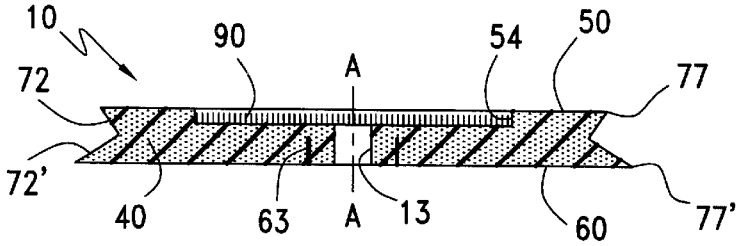
FIG. 44 is a cross sectional view taken along line 44—44 of FIG. 43.
Figure 45:
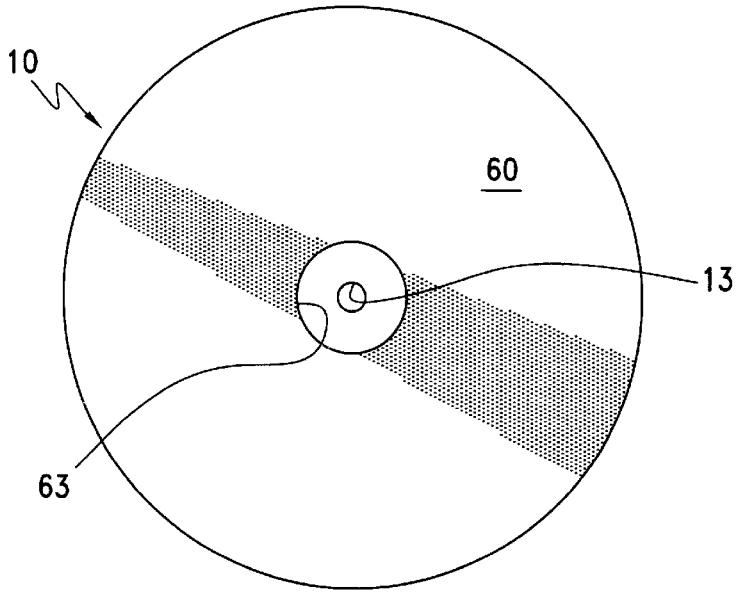
FIG. 45 is a bottom plan view of the surface conditioning pad of FIG. 42.
Figure 46:
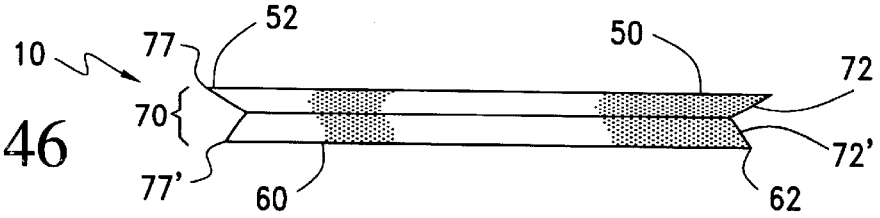
FIG. 46 is a side elevational view of a truncated inverted unequal bottom reduced double taper configuration of a surface conditioning pad, wherein the left, right, front and rear of views are identical.
Figure 47:
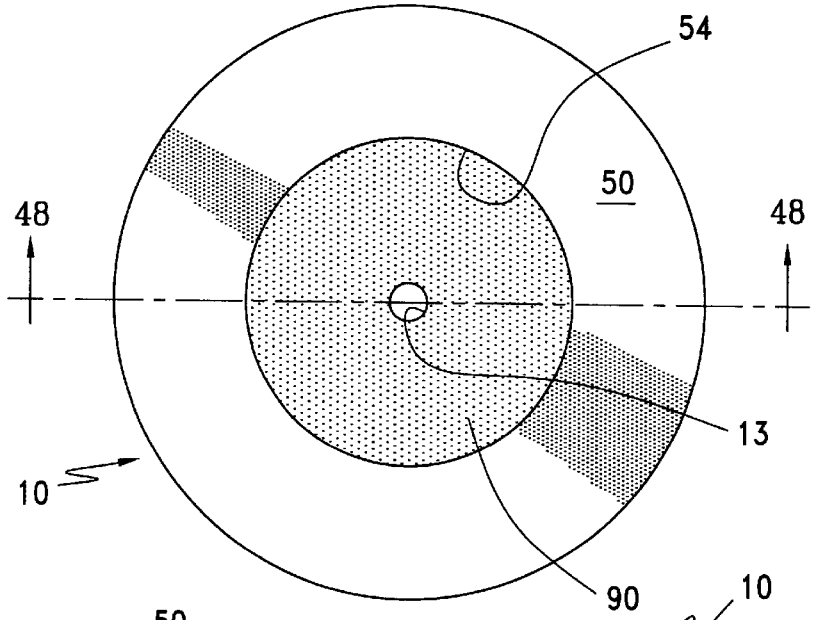
FIG. 47 is a top plan view of the surface conditioning pad of FIG. 46.
Figure 48:
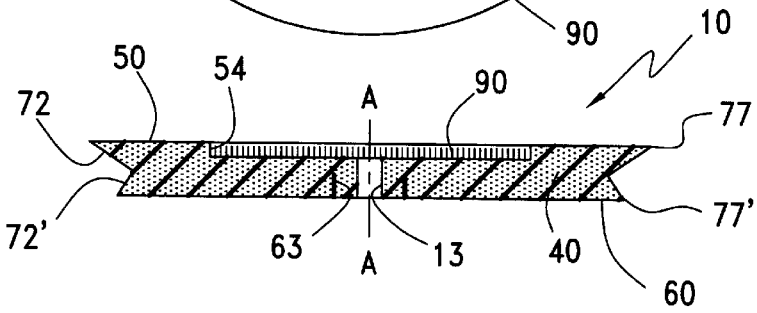
FIG. 48 is a cross sectional view taken along line 48—48 of FIG. 47.
Figure 49:
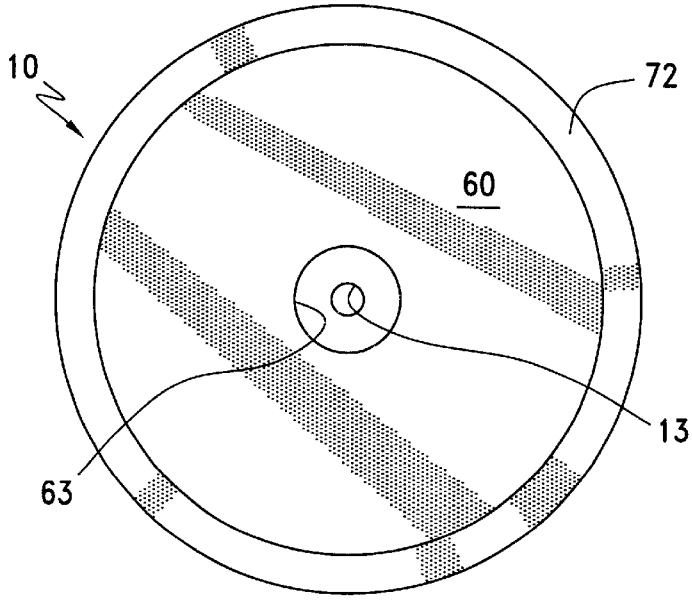
FIG. 49 is a bottom plan view of the surface conditioning pad of FIG. 46.

As shown in FIGS. 5, 9 and 13, the working surface 60 includes a relief cut 63 concentric with the central aperture 13. The relief cut 63 does not extend through the foam body 40 but penetrates a substantial thickness of the foam body. The spacing of the relief cut 63 and the depth of the relief cut are selected to allow for local compression of the foam body 40 by the nut and washer of the drive mechanism, without distorting the remaining area of the working surface 60.

The working surface 60 is a generally planar construction including the relief cut 63. Although the working surface 60 is shown having a continuous surface, it is understood the working surface may include grooves, channels or recess.

The foam of the body 40 is an opened cell polymeric reticulated foam. Depending upon the anticipated surface conditioning to be accomplished by the pad 10, the foam may have a variety of rigidities or cell structures for various applications including heavy cut, medium cut, light cut, polish, soft polish and final finish. Commercially available foams include those manufactured by RevPac or Foam Design.

Figure 2:
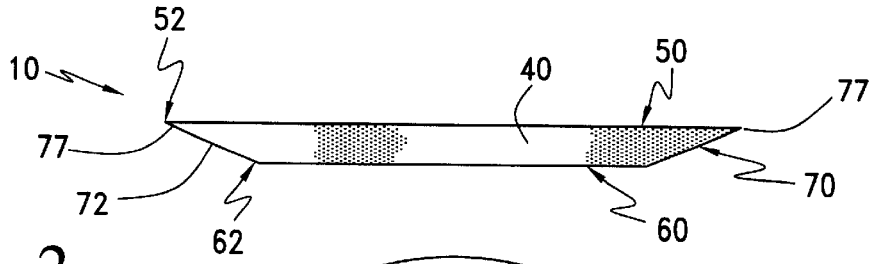
FIG. 2 is a side elevational view of a single taper configuration of the surface conditioning pad, wherein the left, right, front and rear of views are identical.
Figure 3:
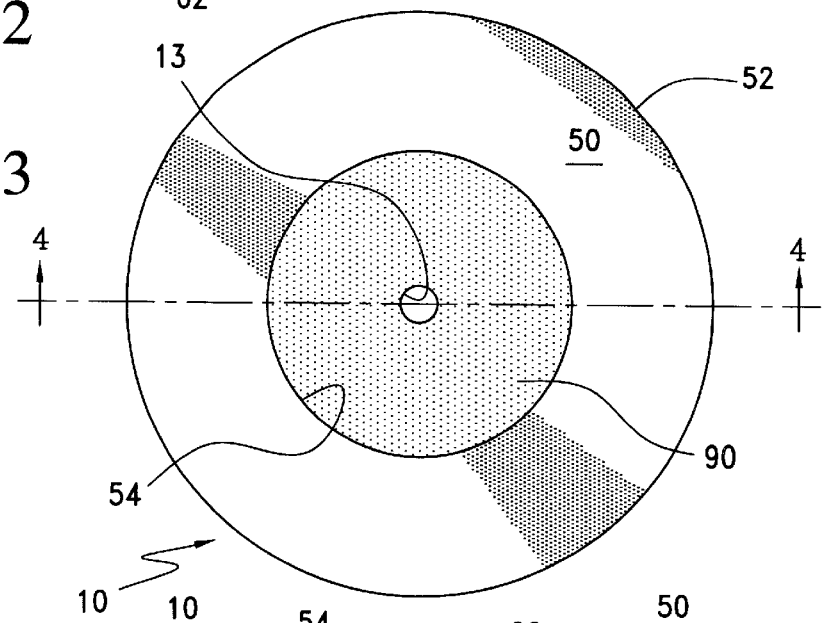
FIG. 3 is a top plan view of the surface conditioning pad of FIG. 2.
Figure 4:
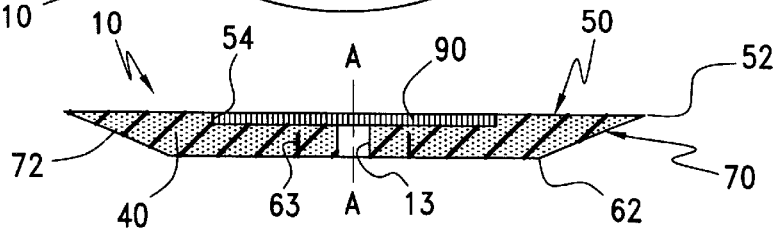
FIG. 4 is a cross sectional view taken along line 4—4 of FIG. 3.
Figure 53:
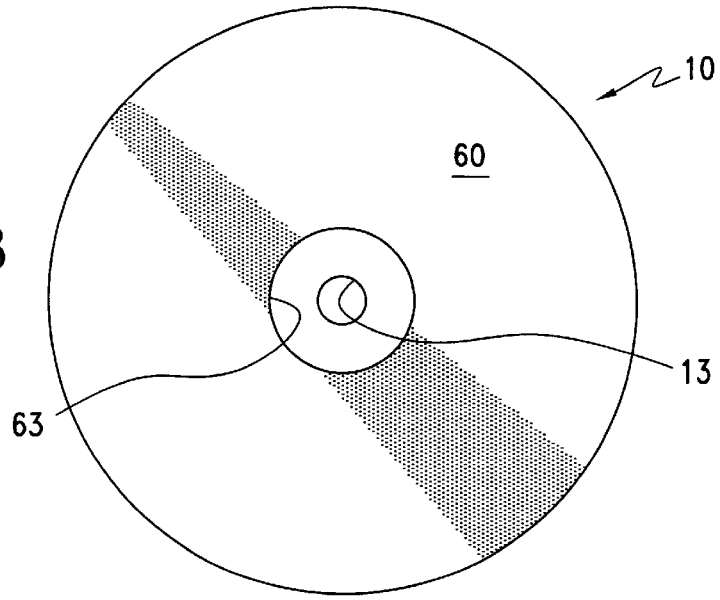
FIG. 53 is a bottom plan view of the surface conditioning pad of FIG. 50.
Figure 58:
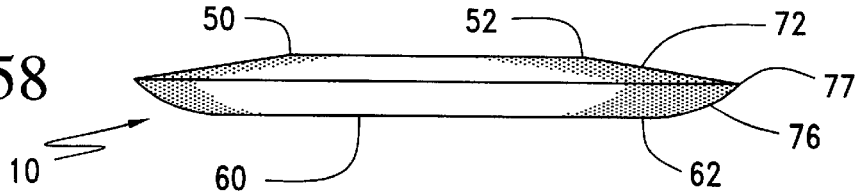
FIG. 58 is a side elevational view of a rounded taper configuration of a surface conditioning pad, wherein the left, right, front and rear of views are identical.
Figure 59:
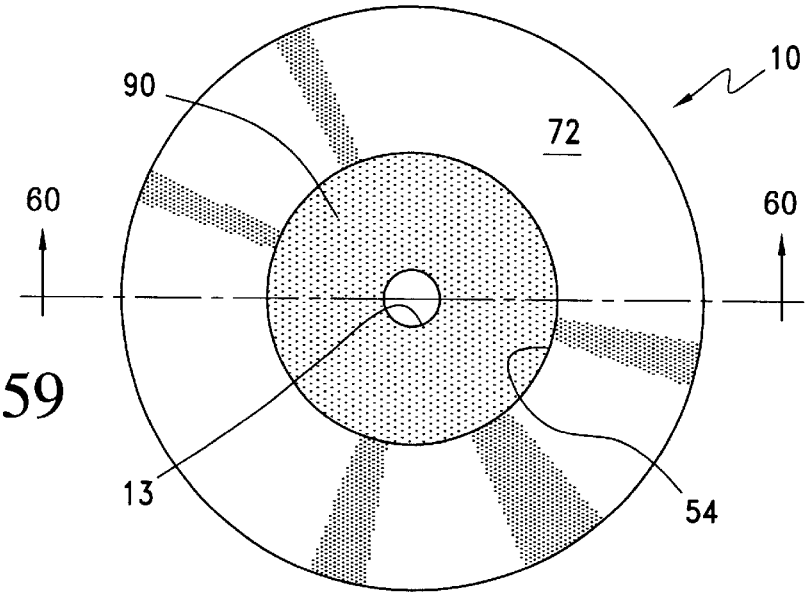
FIG. 59 is a top plan view of the surface conditioning pad of FIG. 58.
Figure 60:
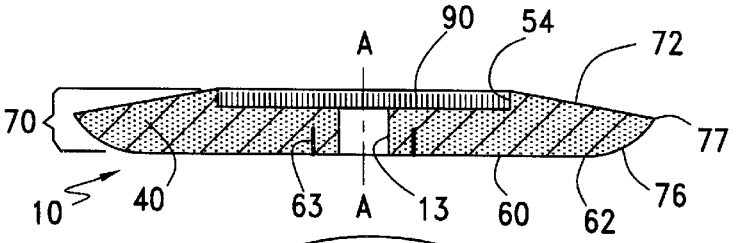
FIG. 60 is a cross sectional view taken along line 60—60 of FIG. 59.
Figure 61:
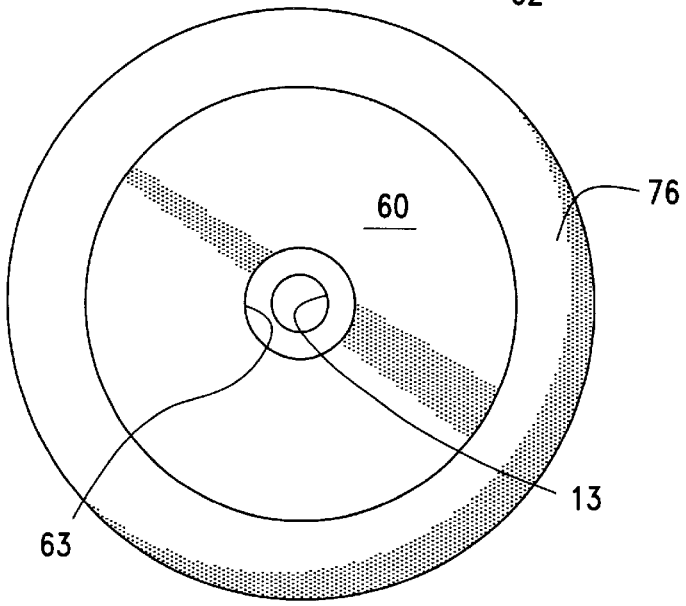
FIG. 61 is a bottom plan view of the surface conditioning pad of FIG. 58.

The peripheral surface 70 extends between the rear periphery 52 and the front periphery 62. As shown in the figures, the peripheral surface 70 may include inclined facets 72 (FIGS. 2–53), axial facets 74 (FIGS. 6–9 and 14–17) and curvilinear facets 76 (FIGS. 54–61). The facets intersect to form a vertex 75 or an apex 77, wherein the apex is located at a radius at least as great as the larger of the rear periphery 52 and the front periphery 62.

Referring to FIGS. 2–5, a single taper configuration of the conditioning pad 10 is shown. In the single taper configuration, the diameter of the rear surface 50 is greater than the diameter of the working surface 60 and a single planar inclined facet 72 of the peripheral surface 70 connects the rear periphery 50 to the front periphery 62. The inclined facet 72 lies in a plane that intersects the axis of rotation A—A. In the configuration of FIGS. 2–5, the angle defined by the peripheral surface 70 and the rear surface 50 is acute and the angle defined by the peripheral surface and the working surface 60 is obtuse. Preferably, the inclined facet 72 of the peripheral surface 70 and the rear surface 50 define an angle between approximately 25° and 65° and the peripheral surface and the working surface 60 define an angle between approximately 115° and 155°. The angle of inclination of the inclined facet 72 is at least partially determined by the intended use of the pad as well as any accompanying compounds employed in the process.

The inclined surface 72 and the rear surface thus define an apex 77, at the greatest diameter of the pad 10. The apex 77 allows the operator to employ the working surface to finish large generally flat areas, while avoiding or reducing contact of the apex with the work piece. Upon the necessity of finishing a crack or a crevice in the work piece, the surface conditioning pad 10 is oriented so that the apex 77 is disposed in the crack or crevice.

Referring to FIGS. 6–9, a truncated single taper configuration is shown. In this configuration, the rear surface 50 has a larger diameter than the working surface 60. The peripheral surface 70 includes the inclined facet 72 and an axial facet 74. The axial facet 74 defines a cylindrical surface concentric with the axis of rotation A—A. The axial facet 74 intersects the rear periphery 52, the inclined facet 72 intersects the front periphery 60. The axial facet 74 and the inclined facet 72 intersect to form a vertex 75.

Referring to FIGS. 10–13, an inverted single taper configuration is shown. In this configuration, the diameter of the rear surface 50 is less than the diameter of the working surface 60 and a single facet peripheral surface 70 includes a single inclined facet 72 interconnect the rear periphery and front periphery. An apex 77 is formed at the intersection of the inclined facet 72 and the front periphery 62. The angle of the apex 77 may be any of a variety of angles as dictated by the intended use of the surface conditioning pad 10.

Referring to FIGS. 14–17, an inverted truncated single taper configuration of the surface conditioning pad 10 is shown. In this configuration, the peripheral surface 70 is defined by an inclined facet 72 and an axial facet 74. The length of the axial facet 74 along the axis of rotation A—A is determined in part by the intended operating characteristics of the surface finishing pad 10. Thus, the peripheral surface 70 may define a flattened apex or a relatively blunt surface.

Referring to FIGS. 18–21, an unequal double taper configuration of the surface conditioning pad 10 is shown. In this configuration, the peripheral surface 70 includes two inclined facets 72, 72', The facet 72 is rearward facet and facet 72' is a forward facet, wherein the angle of inclination of the two inclined facets are not mirror angles. That is, one of the facets lies closer to orthogonal to the axis of rotation A—A than the remaining facet. An apex 77 is formed at the intersection of the inclined facets 72, 72', wherein the location of the apex along the axis of rotation A—A may be determined by the angle of the respective inclined facets and the length of the respective facets and hence a diameter of the working surface 60 or the rear surface 50.

Referring to FIGS. 22–25, a truncated unequal double taper configuration of the surface conditioning pad 10 is shown. In this configuration, the peripheral surface 70 includes two inclined facets 72, 72' and an axial facet 74. In this configuration, each of the inclined facets 72, 72' is at a unique angle from orthogonal to the axis of rotation A—A. The longitudinal dimension of the axial facet 74 is at least partially determined by the intended working perimeters of the surfacing conditioning pad 10.

Referring to FIGS. 26–29, an inverted unequal double taper configuration of the surface conditioning pad 10 is shown. In this configuration, the peripheral surface 70 includes two inclined facets 72, 72', The facet 72 is a rearward facet and facet 72' is a forward facet, wherein the angle of inclination of the two inclined facets are not mirror angles. That is, one of the facets lies closer to orthogonal to the axis of rotation A—A than the remaining facet. For this configuration, the forward facet 72' lies closer to orthogonal to the axis of rotation A—A, than the rearward facet 72. An apex 77 is formed at the intersection of the inclined facets 72, 72', wherein the location of the apex along the axis of rotation A—A may be determined by the angle of the respective inclined facets and the length of the respective facets and hence a diameter of the working surface 60 or the rear surface 50. The inclination of the facets and hence spacing of the apex 77 from the front periphery and the rear periphery allows an operator to access and condition previously inaccessible areas. That is, the thin taper allows the peripheral surface to contact a crevice in the work piece without the material of the pad interfering. This advantage is particularly applicable to those configurations having the apex 77 located radially outward of the rear periphery 52 and the front periphery 62.

Referring to FIGS. 30–33, an inverted truncated unequal double taper configuration of the surface conditioning pad 10 is shown. In this configuration, the peripheral surface 70 includes two inclined facets 72, 72' and an axial facet 74. In this configuration, each of the inclined facets 72, 72' is at a unique angle from orthogonal to the axis of rotation A—A, wherein the forward facet 72' lies closer to the orthogonal to the axis of rotation than the rearward facet 72. The longitudinal dimension of the axial facet 74 is at least partially determined by the intended working perimeters of the surfacing conditioning pad 10.

Referring to FIGS. 34–37, a truncated equal double taper configuration of the surface conditioning pad 10 is shown. In this configuration, the peripheral surface 70 includes a pair of inclined facets 72, 72' each intersecting the axis of rotation A—A at an equal but mirror angle and an intermediate axial facet 74. The angle of the inclined facets 72, 72' and the length of the axial facet 74 along the axis of rotation A—A is at least partially determined by the intended operating environment for the surface conditioning pad 10.

Referring to FIGS. 38–41, an equal double taper inverted configuration of the surface conditioning pad 10 is shown. In this configuration, the rear periphery 52 and the front periphery 62 are equal and the peripheral surface 70 includes a pair of intersecting inclined facets 72, 72' wherein the inclined facets intersect each other at a location circumscribed by the rear periphery and the front periphery. The double taper inverted configuration provides an upper apex 77 and a lower apex 77' for selectively engaging a work piece. The angle defined by the apex may be at least partially determined by the intended operating environment of the pad 10.

Referring to FIGS. 42–45, a double unequal inverted taper configuration for the surface conditioning pad 10 is shown. In this configuration, the rear surface 50 has a smaller diameter than the working surface 60. The peripheral surface includes two intersecting inclined facets 72, 72' wherein the facet 72 intersects the rear periphery 52 to form a rear apex 77, the facet 72' intersects the forward periphery 62 to form a front apex 77', and the facets intersect each other. The intersection of the inclined facets 72, 72' is located at a periphery that is less than the rear periphery and the front periphery. The angle of the rear apex 77 and the front apex 77' are different and the particular value is partially determined by the intended operation of the pad 10. The rear apex 77 defines a larger angle than the front apex 77'.

Referring to FIGS. 46–49, an unequal double inverted taper configuration of the surface conditioning pad 10 is shown. In this configuration, the rear periphery 52 is greater than the front periphery 62 and the peripheral surface includes a rearward inclined facet 72 and a forward inclined facet 72'. The rearward facet 72 intersects the plane of the rear surface 50 at a smaller angle than the forward facet 72' intersects the plane of the working surface 60. In this configuration, the rear apex 77 and the front apex 77' again define different angler wherein the front apex angle is greater than the rear apex angle.

Figure 50:
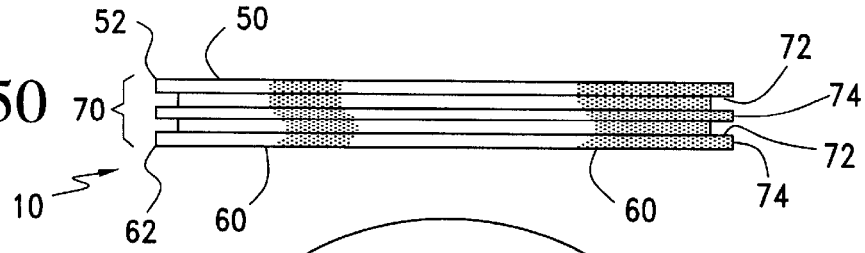
FIG. 50 is a side elevational view of a multi-tooth configuration of a surface conditioning pad, wherein the left, right, front and rear of views are identical.
Figure 51:
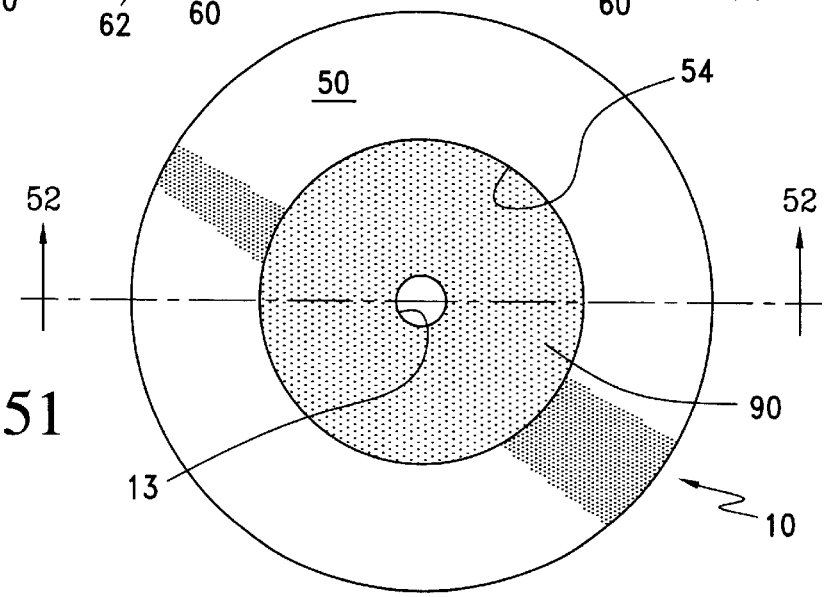
FIG. 51 is a top plan view of the surface conditioning pad of FIG. 50.
Figure 52:
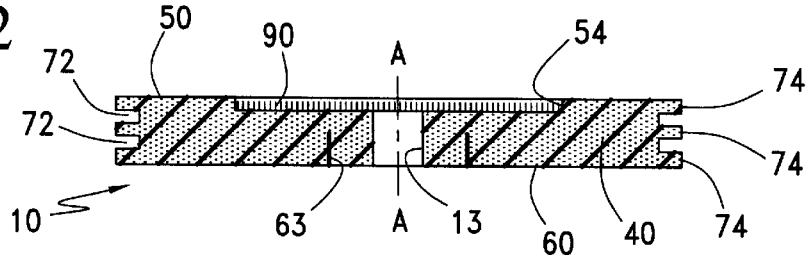
FIG. 52 is a cross sectional view taken along line 52—52 of FIG. 51.

Referring to FIGS. 50–53, a multi-tooth configuration of the surface conditioning pad 10 is shown. In this configuration, the peripheral surface 70 includes a plurality of intersecting facets 72 and axial facets 74. The peripheral surface 70 defines a plurality of teeth as shown in FIGS. 50 and 52. The radial and axial dimension of the teeth is at least partially determined by the intended working perimeters of the pad 10. The number of teeth may vary from two to twenty.

Referring to FIGS. 54–57, a scallop configuration of the surface conditioning pad 10 is shown. The rear periphery 52 and the front periphery 62 are substantially equal in this configuration. The peripheral surface 70 includes a scalloped or wavy surface having a plurality of generally axially extending peaks and valleys. The depth and sizing of the waves are at least partially determined by the intended operating characteristics of the pad 10.

Referring to FIGS. 58–61, a rounded taper configuration of the surface conditioning pad 10 is shown. In this configuration, the rear periphery 52 is less than the front periphery 62 and the peripheral surface 70 includes an inclined facet 72 and a curvilinear facet 76. The inclined facet 72 extends from the rear periphery and the curvilinear periphery 76 extends from the front periphery 62. The inclined facet 72 and the curvilinear facet 76 intersect to form an apex 77. The position of the apex relative to the rear surface 50 and the working surface 60 is at least partially determined by the intended operating perimeters of the pad 10.

As shown in FIG. 62, the shoulder 54 of each of the surface conditioning pads may be sized to receive a coupler pad 120. The coupler pad includes a backing plate engaging surface 122 having a complimentary fastener to the backing plate 12, and a pad engaging surface 124 having a complimentary fastener to the surface conditioning pad 10. By employing the coupler pad 120, the surface conditioning pad 10 has a reduced materials requirement. That is, the volume of material in the coupler pad 120 is no longer located in the surface conditioning pad 10. Therefore, as the surface conditioning pad 10 becomes worn, torn or ineffective, the surface conditioning pad can be readily removed from the coupler pad 120 and a new surface conditioning pad installed. Thus, the amount of material that is lost when a surface conditioning pad is replaced is reduced. The construction of the surface conditioning pad 10 to accommodate the coupler pad 120 can be applied to any of the surface conditioning pad configurations disclosed. Therefore, although the coupler pad 10 construction is shown only with the single taper design, it is understood that each of the other configurations could include the shoulder 54 sized to receive the coupler pad 120.

While a preferred embodiment of the invention has been shown and described with particularity, it will be appreciated that various changes and modifications may suggest themselves to one having ordinary skill in the art upon being appraised of the present invention. It is intended to encompass all such changes and modifications as fall within the scope and spirit of the appended claims.

What is claimed is:

1. A surface conditioning pad for rotation about an axis, the surface conditioning pad comprising a resilient foam body having a rear surface and a working surface substantially orthogonal to the axis, the working surface spaced from the rear surface along the axis, the body including a peripheral surface extending between the rear surface and the working surface, the peripheral surface consisting of the resilient foam and having an apex spaced from a mid-point intermediate the working surface and the rear surface, the apex defining an angle between approximately 25° and 65°.

2. The surfacing conditioning pad of claim 1, wherein the peripheral surface includes a pair of intersecting facets.

3. The surface conditioning pad of claim 2, wherein the apex is formed by the intersecting facets.

4. The surface conditioning pad of claim 1, wherein the peripheral surface includes at least three facets.

5. The surface conditioning pad of claim 1, wherein the rear surface is circumscribed by a rear periphery and the working surface is circumscribed by a front periphery, the apex being nearer the axis than one of the rear periphery and the front periphery.

6. The surface conditioning pad of claim 1, wherein the rear surface is circumscribed by a rear periphery and the working surface is circumscribed by a front periphery, the apex being further from the axis than the rear periphery and the front periphery.

7. The surface conditioning pad of claim 1, further comprising a coupler pad having a pad engaging surface selected to releasably engage a portion of the rear surface.

8. A surface conditioning pad for rotation about an axis, the surface conditioning pad comprising a resilient foam body having a rear surface and a working surface substantially orthogonal to the axis, the working surface spaced from the rear surface along the axis, the body including a peripheral surface extending between the rear surface and the working surface, the peripheral surface having three facets and consisting of the resilient foam.

9. A surface conditioning pad for rotation about an axis, comprising a resilient foam body having a rear surface and a working surface substantially orthogonal to the axis, the working surface spaced from the rear surface along the axis, the body including a peripheral surface including an inclined facet and a curvilinear facet, the peripheral surface consisting of the resilient foam.

10. A surface conditioning pad for rotation about an axis, the surface conditioning pad comprising a resilient foam body having a rear surface defined by a rear periphery and a working surface defined by a working periphery, the rear surface and the working surface being substantially orthogonal to the axis, the working surface spaced from the rear surface along the axis, the body including a peripheral surface extending between the rear periphery and the working periphery, the peripheral surface having an apex spaced from the axis and lying within the working periphery and the rear periphery, the peripheral surface consisting of the resilient foam.

11. A surface conditioning pad assembly for releasably engaging a backing plate, comprising:

(a) a surface conditioning pad having a working surface and a recessed engaging surface; and (b) a coupler pad sized to be received in the recessed engaging surface, the coupler pad releasably engaging the backing plate and the surface conditioning pad.

12. The surface conditioning pad assembly of claim 11, wherein the coupler pad includes a backing plate engaging surface having a releasable fastener selected to releasably engage the backing plate and a pad engaging surface having a second releasable fastener selected to releasably engage the engaging surface.

13. A surface conditioning pad assembly releasably connecting to a backing plate for rotation about an axis, the surface conditioning pad assembly comprising:

(a) a resilient foam body having a rear surface and a working surface substantially orthogonal to the axis, the working surface spaced from the rear surface along the axis, the body including a peripheral surface extending between the rear surface and the working surface, the peripheral surface having an apex spaced from a mid-point intermediate the working surface and the rear surface, and the rear surface including a recessed engaging surface; and (b) a coupler pad sized to be received in the recessed engaging surface and releasably engaging the recessed engaging surface and the backing plate.

14. A surface conditioning pad assembly releasably connecting to a backing plate for rotation about an axis, the surface conditioning pad assembly comprising:

(a) a resilient foam body having a rear surface and a working surface substantially orthogonal to the axis, the working surface spaced from the rear surface along the axis, the body including a peripheral surface formed of a single facet extending between the rear surface and the working surface, the rear surface including a recessed engaging surface; and (b) a coupler pad sized to be received in the recessed engaging surface and releasably engaging the recessed engaging surface and the backing plate.

15. A surface conditioning pad assembly releasably connecting to a backing plate for rotation about an axis, the surface conditioning pad assembly comprising:

(a) a resilient foam body having a rear surface and a working surface substantially orthogonal to the axis, the working surface spaced from the rear surface along the axis, the body including a peripheral surface including an inclined facet and a curvilinear facet; and (b) a coupler pad sized to be received in the recessed engaging surface and releasably engaging the recessed engaging surface and the backing plate.

16. A surface conditioning pad assembly releasably connecting to a backing plate for rotation about an axis, the surface conditioning pad assembly comprising:

(a) a resilient foam body having a rear surface defined by a rear periphery and a working surface defined by a working periphery, the rear surface and the working surface being substantially orthogonal to the axis, the working surface spaced from the rear surface along the axis, the body including a peripheral surface extending between the rear periphery and the working periphery, the peripheral surface having an apex spaced from the axis and lying within the working periphery and the rear periphery; and (b) a coupler pad sized to be received in the recessed engaging surface and releasably engaging the recessed engaging surface and the backing plate.

* * * * *